US009883721B2

(12) United States Patent
Cohen

(10) Patent No.: US 9,883,721 B2
(45) Date of Patent: Feb. 6, 2018

(54) PALM BRACELET

(71) Applicant: M. Cohen, Inc., Los Angeles, CA (US)

(72) Inventor: Maor M. Cohen, Los Angeles, CA (US)

(73) Assignee: M. Cohen, Inc., Los Angeles, CA (US)

( * ) Notice: Subject to any disclaimer, the term of this patent is extended or adjusted under 35 U.S.C. 154(b) by 291 days.

(21) Appl. No.: 14/624,523

(22) Filed: Feb. 17, 2015

(65) Prior Publication Data

US 2016/0235169 A1 Aug. 18, 2016

(51) Int. Cl.

| | |
|---|---|
| ***A44C 5/00*** | (2006.01) |
| ***A44C 5/20*** | (2006.01) |
| ***A44C 11/00*** | (2006.01) |
| *A44C 15/00* | (2006.01) |

(52) U.S. Cl.

CPC ..... *A44C 5/2014* (2013.01); *A44C 5/0061* (2013.01); *A44C 5/20* (2013.01); *A44C 11/00* (2013.01); *A44C 15/0075* (2013.01)

(58) Field of Classification Search

CPC ..... A44C 15/0045; A44C 15/006; A44C 15/0075; A44C 15/0085; A44C 15/009; A44C 5/00; A44C 5/0053; A44C 5/0061; A44C 13/00; A44C 11/00; A44C 15/001; A44C 5/2014; A44C 5/20

USPC ..... 63/3, 4

See application file for complete search history.

(56) References Cited

U.S. PATENT DOCUMENTS

| | | | | |
|---|---|---|---|---|
| 2004/0007017 | A1 | 1/2004 | Flaherty | |
| 2006/0144083 | A1 | 7/2006 | Layton | |
| 2006/0191291 | A1* | 8/2006 | White | A44C 15/0055 63/4 |

FOREIGN PATENT DOCUMENTS

| | | | | |
|---|---|---|---|---|
| DE | 8110052 | U1 | 7/1981 | |
| FR | 2861552 | A1 * | 5/2005 | A41B 9/002 |
| JP | HOB131223 | A | 5/1996 | |
| KR | 200168567 | Y1 | 2/2000 | |

OTHER PUBLICATIONS

International Search Report and the Written Opinion for International App No. PCT/US2016/018192, dated Apr. 4, 2016, European Patent Office.

* cited by examiner

*Primary Examiner* — Jack W Lavinder

(74) *Attorney, Agent, or Firm* — Sheppard, Mullin, Richter & Hampton LLP; Daniel Yannuzzi; Jesse Salen

(57) ABSTRACT

Embodiments of the present disclosure provide a multi-membered bracelet. The palm bracelet includes three members connected by connecting chains. In some embodiments, one of the three members is configured to rest within the space between the thumb and index finger. In some embodiments, one of the connecting chains is configured to rest within the space between the thumb and index finger.

21 Claims, 4 Drawing Sheets

PALM BRACELET

TECHNICAL FIELD

The disclosed technology relates generally to bracelets, and more particularly, some embodiments relate to palm bracelets designed to wrap around the wrist and the thumb.

DESCRIPTION OF THE RELATED ART

In the field of jewelry design, bracelets are loops of material intended to be worn around the wrist (or the ankle) for decorative or other purposes. Bracelets may be made out of various materials, including gold, silver, platinum and other metals, leather or cloth, Lucite or Lexan, or variety a of different materials alone or in combination. In some cases, a bracelet may be a closed loop or an arch with an opening to allow the bracelet to be slipped onto the wrist. Bracelets are generally intended to rest on the wrist without attachment to the person's clothing.

Generally, bracelets do not grasp tightly around a person's wrist but provide some slack, in order to avoid cutting off circulation or leaving an undesirable mark on the wrist. Bracelets tend to be sized in various ranges, such as small, medium, and large. Due to the weight of the material and other adornments, bracelets occasionally fall further down a person's wrist than intended. Constant readjustment is required in order to have the bracelet sit upon the wrist as intended. The opposite issue also occurs, with the bracelet resting too high on the wrist, obscuring the bracelet from sight.

One conventional solution attaches the bracelet to another piece of jewelry on the person's hand, such as a ring. This solution, however, requires additional measurement of the person's ring size, which requires more precise sizing than traditionally used for bracelets. Attachment to a ring also requires excess slack in the chain connecting the bracelet to the ring to account for the movement of the person's fingers, and the connecting chain may catch on clothing or other objects and cause annoyance to the wearer. In addition, the need to attach the bracelet to another piece of jewelry eliminates the person's ability to wear a more desirable piece on their hand.

BRIEF SUMMARY OF EMBODIMENTS

According to various embodiments of the present disclosure, a palm bracelet is provided which wraps around a person's wrist and has a portion that rests between the thumb and index finger of the hand. Embodiments of the palm bracelet sit more consistently on the wrist than traditional bracelets, without falling or requiring a tight fit around the person's wrist. The palm bracelet can also be configured with the appropriate dimensions of its members to avoid the need attach the bracelet to another piece of jewelry or an article of clothing to maintain the bracelet's position on the wrist.

According to an embodiment of the present disclosure, a bracelet is provided comprising a first connecting chain having three sections, each prong comprising a proximal end and a distal end, the proximal end of each section is attached to the proximal end of the other two sections; a first member having a first end and a second end, wherein the first end of the first member is attached to the distal end of a first section of the first connecting chain; a second member having a first end and a second end, wherein the first end of the second member is attached to the distal end of a second section of the first connecting chain; a third member having a first end and a second end, wherein the first end of the third member is attached to the distal end of a third section of the first connecting chain; a second connecting chain having a first end and a second end, wherein the first end of the second connecting chain is attached to the second end of the first member, and the second end of the second connecting chain is attached to the second end of the second member; and a third connecting chain having a first end and a second end, wherein the end of the third connecting chain is attached to the second end of the first member, and the second end of the third connecting chain is attached to the second end of the third member.

According to an embodiment of the present disclosure, a bracelet is provided comprising a first member having a proximal end and a distal end; a second member having a proximal end and a distal end; a third member having a proximal end and a distal end; a first connecting chain having a first end and a second end, the first end of the first connecting chain attached to the distal end of the first member and a clasp disposed on the second end of the first connecting chain; a second connecting chain having a first end and a second end, the first end of the second connecting chain attached to the distal end of the second member and a joining member disposed on the second end of the second connecting chain; and a third connecting chain having a first end and a second end, the first end of the third connecting chain attached to the distal end of the third member and a joining member disposed on the second end of the third connecting chain; wherein the proximal end of the first member is attached to the proximal ends of the second member and the third member.

Other features and aspects of the disclosed technology will become apparent from the following detailed description, taken in conjunction with the accompanying drawings, which illustrate, by way of example, the features in accordance with embodiments of the disclosed technology. The summary is not intended to limit the scope of any inventions described herein, which are defined solely by the claims attached hereto.

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

The figures are not intended to be exhaustive or to limit the invention to the precise form disclosed. It should be understood that the invention can be practiced with modification and alteration, and that the disclosed technology be limited only by the claims and the equivalents thereof.

DETAILED DESCRIPTION OF THE EMBODIMENTS

Embodiments of the technology disclosed herein are directed toward a bracelet. More particularly, the various embodiments of the technology disclosed herein relate to palm bracelets that provide consistent positioning of the bracelet on the person's wrist without the need to fit tightly around the wrist or attachment to a ring or other piece of jewelry.

Figure 1:
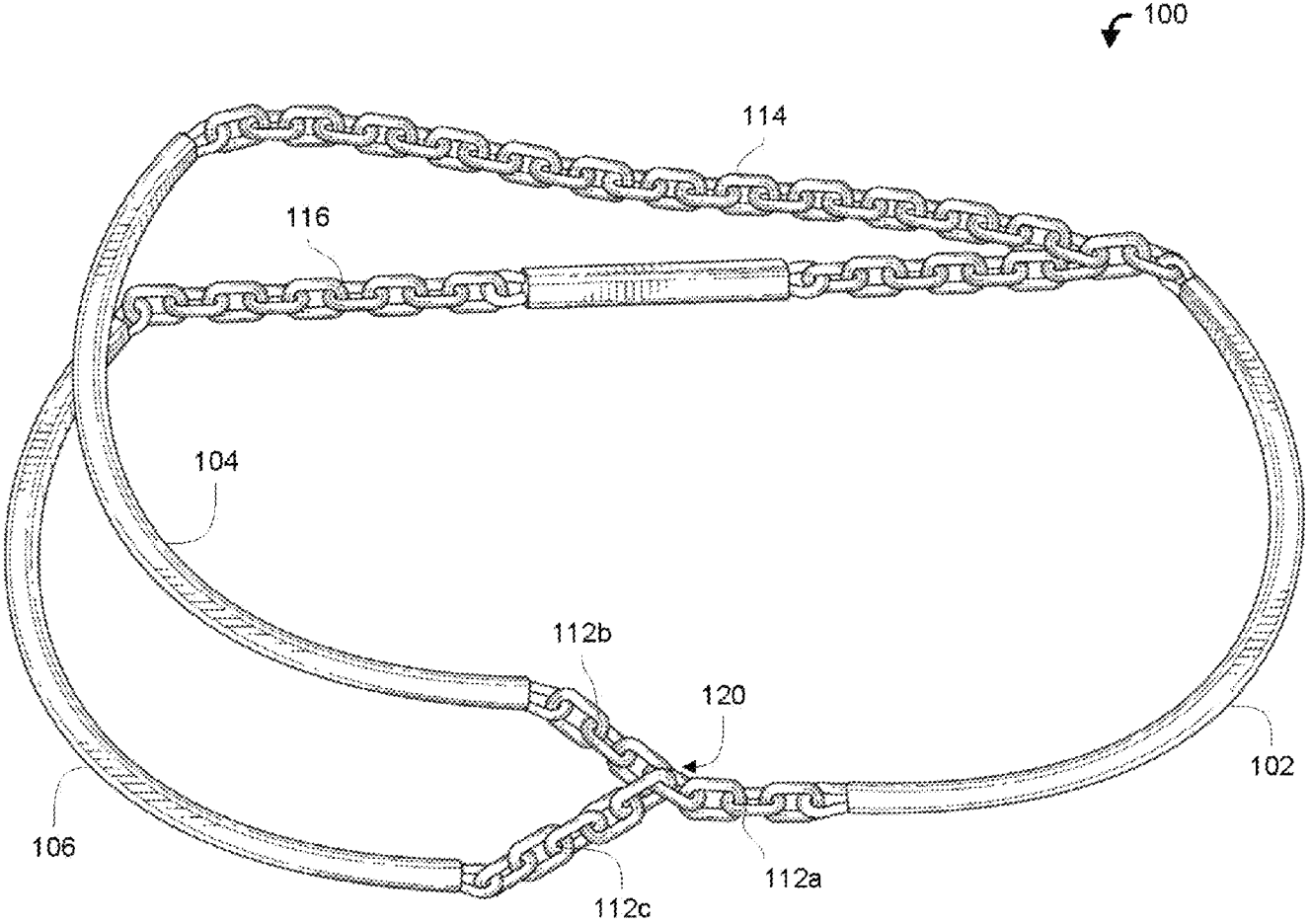
FIG. 1 is an example embodiment of a palm bracelet in accordance with the present disclosure.

FIG. 1 illustrates an example embodiment of the palm bracelet 100 of the present disclosure. As shown in FIG. 1, the palm bracelet includes three members 102, 104, 106. In various embodiments, the members 102, 104, 106 may be formed to contour around a person's wrist and the space between the thumb and index finger of the hand. Although some embodiments may be implemented as being contoured for a person's wrist dimensions and the space between the thumb and index finger, in other embodiments, the members 102, 104, 106 are more generally sized and do not require measurement of a person's anatomical dimensions. The members may be generally sized to fit a range of wrists, similar to the small, medium, and large sizes traditionally used for bracelet sizing. In some embodiments, the members 102, 104, 106 may be contoured for a specific person, if desired.

In some embodiments, the members 102, 104, 106 may be circular or elliptical arcs. In some embodiments, the members 102, 104, 106 may be formed in a polygonal shape, having several sections attached together to form a solid shape contoured for a person's hand. In various embodiments, the members 102, 104, 106 may be a combination of different contour shapes and styles. While members 102, 104, 106 are shown as being solid in shape, other embodiments can include sectioned members with flexible links interconnecting the sections.

The members may also be made of various materials. In some embodiments, the members 102, 104, 106 may be made of any material suitable for jewelry, such as gold, silver, platinum, aluminum, steel, plated metals, or an alloy. In other embodiments, the members 102, 104, 106 may be made of a non-metal material, such as leather, plastic, Lucite, Lexan, animal horns, and stone to name a few. In some embodiments, the members 102, 104, 106 may be made of a combination of materials. Adornments, such as jewels, gemstones, and metals may be disposed on the members.

Connecting chains 112, 114, 116 connect the three members 102, 104, 106. In various embodiments, connecting chain 112 has three sections 112*a*, 112*b*, 112*c*. The three sections 112*a*, 112*b*, 112*c* are connected together at a central point 120. The free end of each section 112*a*, 112*b*, 112*c* connects to a first end of each member 102, 104, 106, respectively.

Connecting chains 114 and 116 connect to the opposite ends of each member 102, 104, 106. The connecting chain 114 connects member 104 to member 102, and the connecting chain 116 connects member 106 to member 102. In some embodiments, connecting chain 114, connecting chain 116, or both may include a clasp mechanism to allow detachment of connecting chains 114 and 116 from the member 102. In other embodiments, the connecting chains 114 and 116 are attached permanently to the member 102.

The connecting chains 112, 114, 116 may be made of various materials. In various embodiments, the connecting chains 112, 114, 116 may be made of any material suitable for jewelry, such as gold, silver, platinum, aluminum, steel, plated metals, or an alloy. In other embodiments, the connecting chains 112, 114, 116 may be made of a non-metal material, such as leather, plastic, Lucite, Lexan, animal horns, and stone to name a few. In some embodiments, the connecting chains 112, 114, 116 may be made of a combination of materials. In various embodiments, the connecting chains 112, 114, 116 may be configured as, for example, one or more of a ball chain, a mesh chain, a robe chain, a threaded chain, a bar chain, a link chain, or a combination thereof. In various embodiments, the connecting chains 112, 114, 116 may be elastic to allow the bracelet to stretch for purposes of putting on the bracelet.

In the example embodiment of FIG. 1, the members 102, 104, 106 rest on the sides of the wrist and in the space between the thumb and index finger of the hand. In these embodiments, the members 102, 104, 106 provide the support holding the bracelet in position. In other embodiments, the connecting chains 112, 114, 116 may be configured to provide the positioning support, as illustrated in the embodiments of FIGS. 4 and 5, discussed in more detail below.

Figure 2:
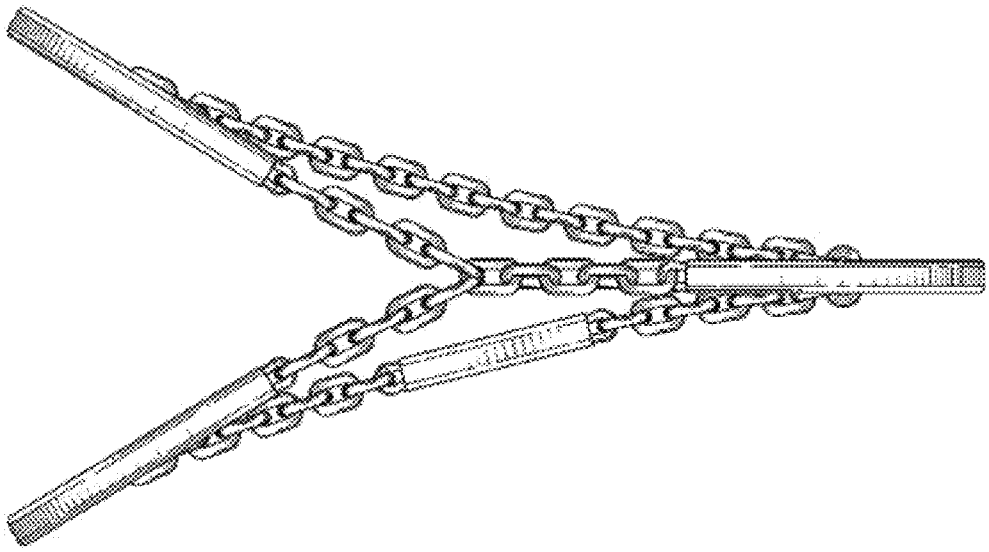
FIG. 2 is a top view of the example embodiment of FIG. 1.
Figure 3:
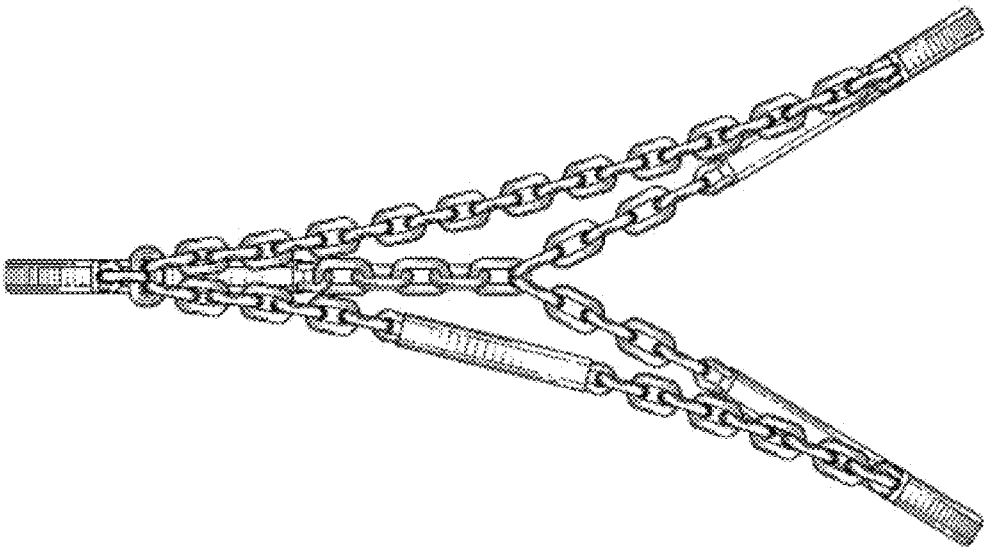
FIG. 3 is a bottom view of the example embodiment of FIG. 1.

FIGS. 2 and 3 show other views of the example embodiment of FIG. 1. FIG. 2 shows a top view of the example embodiment. By top view, it means viewing the bracelet from above as if it was actually on a person's hand. FIG. 3 shows a bottom view of the example embodiment of FIG. 1.

Figure 4:
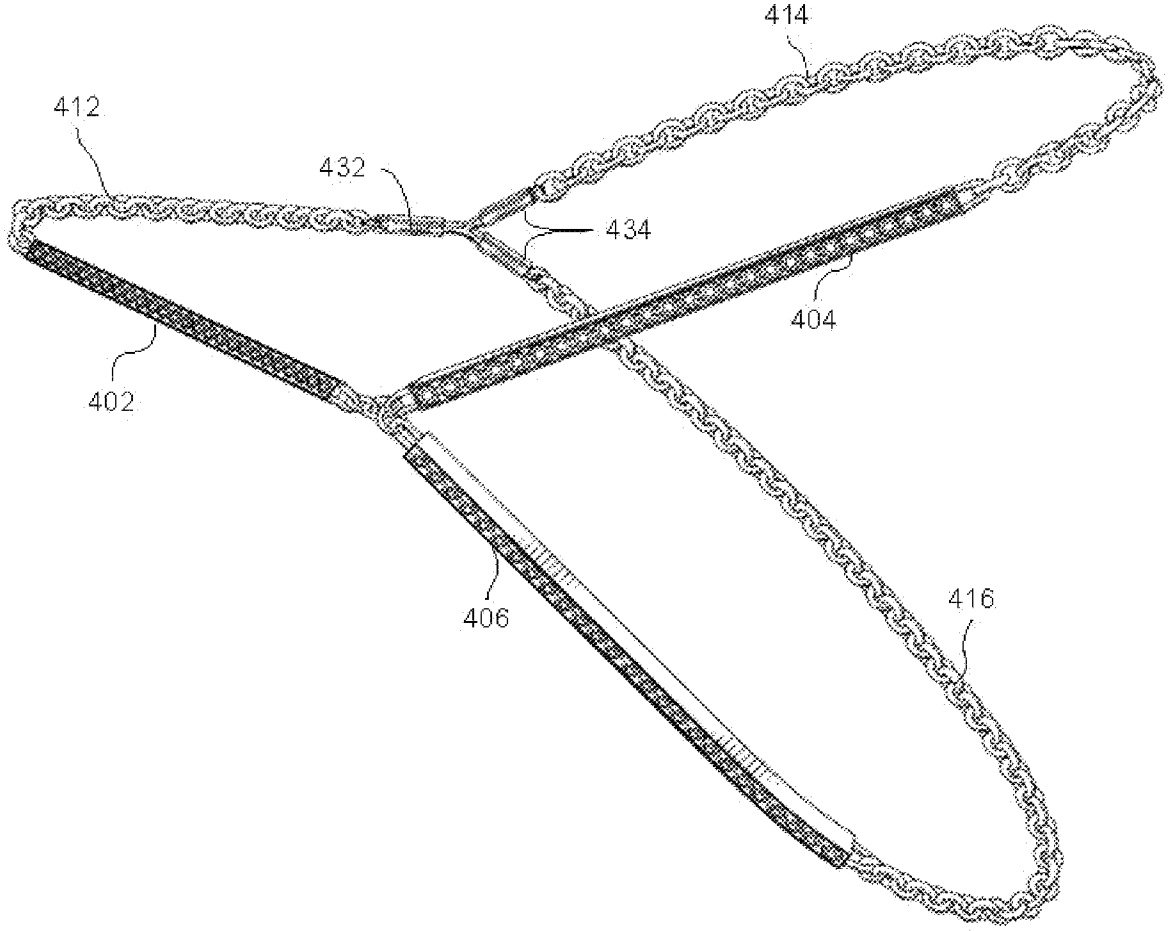
FIG. 4 is another example embodiment of a palm bracelet in accordance with the present disclosure.
Figure 5:
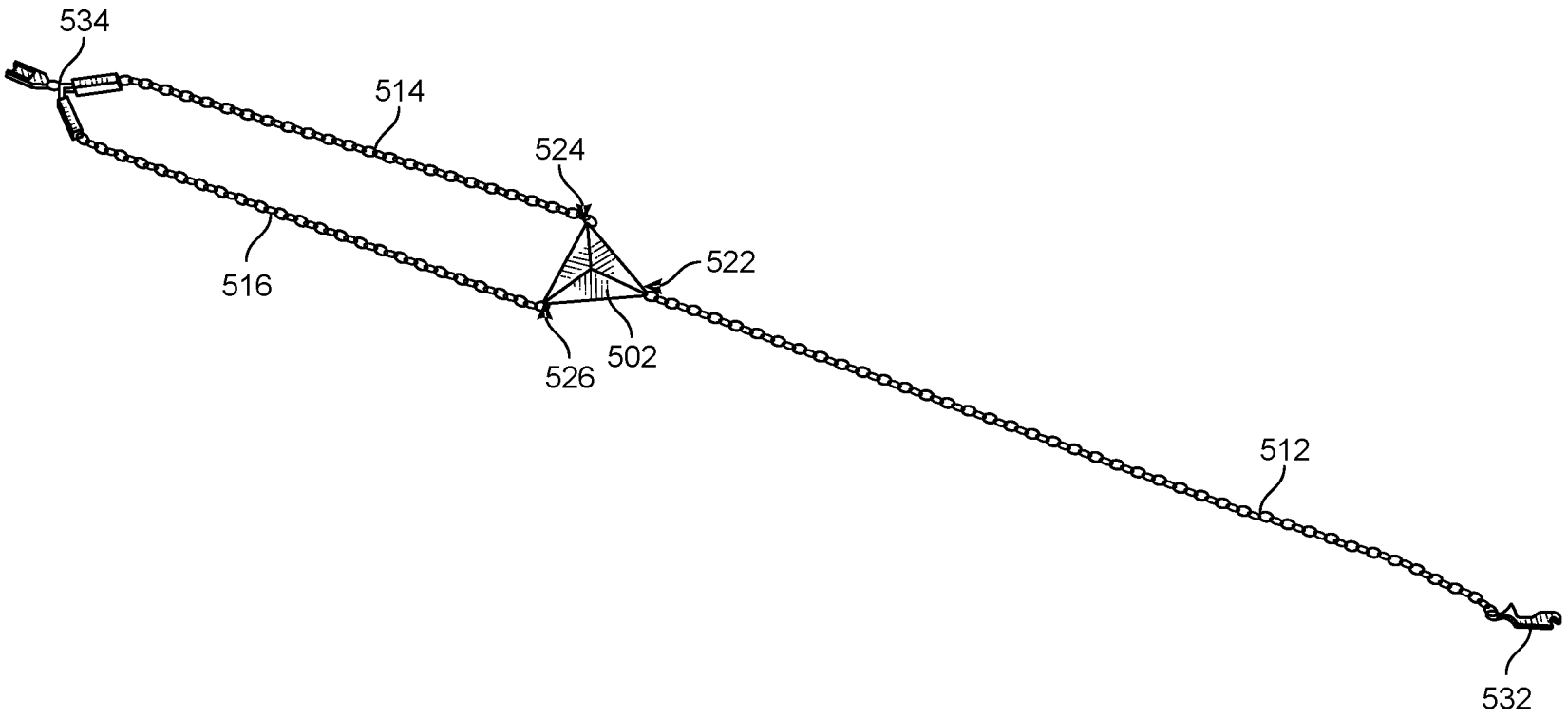
FIG. 5 is another example embodiment of a palm bracelet in accordance with the present disclosure.

FIG. 4 shows another example embodiment of the present disclosure. In FIG. 4, the members 402, 404, 406 are connected together at a central point 420. In some embodiments, the members 402, 404, 406 may be connected by a smaller version of connecting chain 112 shown in FIG. 1. In other embodiments, the members 402, 404, 406 may each have a joining member disposed on a proximal end, with an attachment member connecting the joining members disposed on the proximal ends of each member 402, 404, 406. In some embodiments, the members 402, 404, 406 may be connected by a three-way joint, wherein the three-way joint. In some embodiments, the three-way joint may be designed to allow the members 402, 404, 406 to flex slightly, accounting for movement of the hand.

In some embodiments, the members 402, 404, 406 may be made of any material suitable for jewelry, such as gold, silver, platinum, aluminum, steel, or an alloy. In other embodiments, the members 402, 404, 406 may be made of a non-metal material, such as leather, plastic, or stone. In some embodiments, the members 402, 404, 406 may be made of a combination of materials. Adornments, such as jewels, gemstones, and/or diamonds may be disposed on the members.

In some embodiments, a connecting chain 412, 414, 416 may be disposed on the distal ends of members 402, 404, 406, respectively. In various embodiments, connecting chain 412 includes a clasping mechanism 432 disposed on the end opposite member 402, and connecting chains 414, 406 include a joining member disposed on the end opposite of members 404, 406, respectively. The joining members may be configured to mate with the clasping mechanism 432. In some embodiments, clasping mechanism 432 may be a spring clasp, and the joining members may be eye hooks or chain links. In some embodiments, the clasping mechanism 432 may be a magnetic clasp, and the joining member may be links or metal formations on the end of connecting chains 414, 416 that are configured to mate with the magnetic clasp. In various embodiments, the joining members may include a latch configured to mate with a projection disposed on the rear of the clasp mechanism 432, as known in the art, to provide an additional point of engagement for a stronger connection.

In some embodiments, connecting chains 414 and 416 may be a single chain with a joining member 434 attached to the ends of 414, 416 opposite members 404, 406, respectively. The joining member 434 may be configured similar to the joining members discussed above with respect to connecting chains 414, 416 being two separate chains. In other embodiments, the joining member 434 may be configured to engage with the clasp 432.

The connecting chains 412, 414, 416 may be made of various materials. In various embodiments, the connecting chains 412, 414, 416 may be made of any material suitable for jewelry, such as gold, silver, platinum, aluminum, steel, plated metals, or an alloy. In other embodiments, the connecting chains 412, 414, 416 may be made of a non-metal material, such as leather, plastic, Lucite, Lexan, animal horns, and stone to name a few. In some embodiments, the connecting chains 412, 414, 416 may be made of a combination of materials. In various embodiments, the connecting chains 412, 414, 416 may be configured as, for example, one or more of a ball chain, a mesh chain, a robe chain, a threaded chain, a bar chain, a link chain, or a combination thereof. In various embodiments, the connecting chains 412, 414, 416 may be elastic to allow the bracelet to stretch for purposes of putting on the bracelet.

Another example embodiment of the palm bracelet in accordance with the present disclosure is shown in FIG. 5. In some embodiments, a single member 502 may be used instead of the multiple members illustrated in FIGS. 1-4. The member 502 may be a variety of shapes. As shown in FIG. 5, the member 502 may be a triangular shape. In other embodiments, the member 502 may be rectangular, circular, or polygonal. In some embodiments, the member 502 may be an abstract shape, some non-limiting examples including: animal shaped; letters or words; objects, such as automobiles; stars; faces of persons or characters. In some embodiments, the member 502 may be one piece or a combination of several different sections, with several vertices. The member 502 may be made of any of the materials discussed above with respect to FIGS. 1-4.

The proximal ends of the connecting chains 512, 514, 516 connect to the member 502 at connection points 522, 524, 526 of member 502. The connection point 522 is located on member 502 such that the connecting chain 512 wraps around the person's wrist in the opposite direction of connecting chains 514, 516. In some embodiments, the connection points 522, 524, 526 may be disposed on the edge of member 502. In other embodiment, the connection points 522, 524, 526 may be holes in the member 502. The holes may be configured to allow a link of the connecting chains to attach to the member 502, or may be configured to allow the connecting chains to loop through.

In some embodiments, the member 502 may be made of any material suitable for jewelry, such as gold, silver, platinum, aluminum, steel, or an alloy. In other embodiments, the member 502 may be made of a non-metal material, such as leather, plastic, or stone. In some embodiments, the member 502 may be made of a combination of materials. Adornments, such as jewels, gemstones, and/or diamonds may be disposed on the member 502.

In various embodiments, connecting chain 512 includes a clasping mechanism 532 disposed on the end opposite member 502, and connecting chains 514, 516 include a joining member disposed on the end opposite of member 502. The joining members on the ends of connecting chains 514, 516 may be configured to mate with the clasping mechanism 532. In some embodiments, clasping mechanism 532 may be a spring clasp, and the joining members may be eye hooks or chain links. In some embodiments, the clasping mechanism 532 may be a magnetic clasp, and the joining member may be links or metal formations on the end of connecting chains 514, 516 that are configured to mate with the magnetic clasp. In various embodiments, the joining members may include a latch configured to mate with a projection disposed on the rear of the clasp mechanism 532, as known in the art, to provide an additional point of engagement for a stronger connection.

In some embodiments, connecting chains 514 and 516 may be a single chain with a joining member 534 attached to the ends of 514, 516 opposite member 502. The joining member 534 may be configured similar to the joining members discussed above with respect to connecting chains 514, 516 being two separate chains. In other embodiments, the joining member 534 may be configured to engage with the clasp 532.

The connecting chains 512, 514, 516 may be made of various materials. In various embodiments, the connecting chains 512, 514, 516 may be made of any material suitable for jewelry, such as gold, silver, platinum, aluminum, steel, plated metals, or an alloy. In other embodiments, the connecting chains 512, 514, 516 may be made of a non-metal material, such as leather, plastic, Lucite, Lexan, animal horns, and stone to name a few. In some embodiments, the connecting chains 512, 514, 516 may be made of a combination of materials. In various embodiments, the connecting chains 512, 514, 516 may be configured as, for example, one or more of a ball chain, a mesh chain, a robe chain, a threaded chain, a bar chain, a link chain, or a combination thereof. In various embodiments, the connecting chains 512, 514, 516 may be elastic to allow the bracelet to stretch for purposes of putting on the bracelet.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent.

What is claimed is:

1. A bracelet comprising:

a first connecting chain having three sections, each section comprising a proximal end and a distal end, and the proximal end of each section is attached to the proximal end of the other two sections;

a first member having a first end and a second end, wherein the first end of the first member is attached to the distal end of a first section of the first connecting chain;

a second member having a first end and a second end, wherein the first end of the second member is attached to the distal end of a second section of the first connecting chain;

a third member having a first end and a second end, wherein the first end of the third member is attached to the distal end of a third section of the first connecting chain;

a second connecting chain having a first end and a second end, wherein the first end of the second connecting chain is attached to the second end of the first member, and the second end of the second connecting chain is attached to the second end of the second member; and a third connecting chain having a first end and a second end, wherein the first end of the third connecting chain is attached to the second end of the first member, and the second end of the third connecting chain is attached to the second end of the third member.

2. The bracelet of claim 1, wherein the first, second, and third members comprise gold, silver, platinum, aluminum, steel, or a formable alloy suitable for jewelry.

3. The bracelet of claim 1, wherein the first, second, and third connecting chains comprise one or more of a link chain, a robe chain, a mesh chain, or a metal wire.

4. The bracelet of claim 1, further comprising a clasp.

5. The bracelet of claim 4, wherein the clasp is disposed on the second end of the first member, a joining member disposed on the first end of the second connecting chain, and a joining member disposed on the first end of the third connecting chain, wherein the joining members are configured to mate with the clasp.

6. The bracelet of claim 5, wherein the clasp is a spring clasp and the joining members are eye hooks.

7. The bracelet of claim 5, wherein the clasp is a magnetic clasp and the joining members are configured to mate with the clasp.

8. The bracelet of claim 1, wherein the second member is configured to rest between a thumb and an index finger of a person's hand.

9. A bracelet, comprising:

a first member, having a proximal end and a distal end;

a second member, having a proximal end and a distal end;

a third member, having a proximal end and a distal end;

a first connecting chain having a first end and a second end, the first end of the first connecting chain attached to the distal end of the first member and a clasp disposed on the second end of the first connecting chain;

a second connecting chain having a first end and a second end, the first end of the second connecting chain attached to the distal end of the second member and a joining member disposed on the second end of the second connecting chain; and a third connecting chain having a first end and a second end, the first end of the third connecting chain attached to the distal end of the third member and a joining member disposed on the second end of the third connecting chain;

wherein the proximal end of the first member is attached to the proximal ends of the second member and the third member.

10. The bracelet of claim 9, wherein the first, second, and third members comprise gold, silver, platinum, aluminum, steel, or a formable alloy suitable for jewelry.

11. The bracelet of claim 9, wherein the first, second, and third connecting chains comprise one or more of a link chain, a robe chain, a mesh chain, or a metal wire.

12. The bracelet of claim 9, wherein the clasp is a spring clasp and the joining members are eye hooks.

13. The bracelet of claim 9, wherein the clasp is a magnetic clasp and the joining members are configured to mate with the clasp.

14. The bracelet of claim 9, wherein the second connecting chain is configured to rest between a thumb and an index finger of a person's hand.

15. A bracelet, comprising:

a member having three connection points;

a first connecting chain comprising a first end and a second end, wherein the first end is attached to a first connection point of the member;

a second connecting chain comprising a first end and a second end, wherein the first end is attached to a second connection point of the member; and a third connecting chain comprising a first end and a second end, wherein the first end is attached to a third connection point of the member;

wherein the first connection point of the member is orientated such that the first connecting chain extends in the opposite direction of the second and third connecting chains when the bracelet is worn on a person's wrist; and a clasp is disposed on the second end of the first connecting chain, a joining member is disposed on the second end of the second connecting chain, and a joining member is disposed on the second end of the third connecting chain, wherein the joining members are configured to mate with the clasp.

16. The bracelet of claim 15, wherein the member is one of a triangular, rectangular, circular, polygonal, or abstract shape.

17. The bracelet of claim 15, wherein the member comprises gold, silver, platinum, aluminum, steel, or a formable alloy suitable for jewelry.

18. The bracelet of claim 15, wherein the first, second, and third connecting chains comprise one or more of a link chain, a robe chain, a mesh chain, or a metal wire.

19. The bracelet of claim 15, wherein the clasp is a spring clasp and the joining members are eye hooks.

20. The bracelet of claim 15, wherein the clasp is a magnetic clasp and the joining members are configured to mate with the clasp.

21. The bracelet of claim 15, wherein the second connecting chain is configured to rest between a thumb and an index finger of a person's hand.

* * * * *